US009458564B2

(12) United States Patent
Kang et al.

(10) Patent No.: US 9,458,564 B2
(45) Date of Patent: Oct. 4, 2016

(54) WASHING MACHINE

(71) Applicant: SAMSUNG ELECTRONICS CO., LTD., Suwon-si, Gyeonggi-do (KR)

(72) Inventors: Dae Gyu Kang, Suwon-si (KR); Young Hyun Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 15 days.

(21) Appl. No.: 14/450,415

(22) Filed: Aug. 4, 2014

(65) Prior Publication Data

US 2015/0040619 A1 Feb. 12, 2015

Related U.S. Application Data

(60) Provisional application No. 61/863,085, filed on Aug. 7, 2013.

(30) Foreign Application Priority Data

Aug. 7, 2013 (KR) ..... 10-2013-0093674

(51) Int. Cl.

| | |
|---|---|
| ***D06F 39/12*** | (2006.01) |
| ***D06F 39/08*** | (2006.01) |
| ***D06F 23/02*** | (2006.01) |
| ***D06F 39/02*** | (2006.01) |

(52) U.S. Cl.

CPC ..... *D06F 39/085* (2013.01); *D06F 23/02* (2013.01); *D06F 39/02* (2013.01); *D06F 39/083* (2013.01); *D06F 39/088* (2013.01); *D06F 39/12* (2013.01); *Y10T 137/3149* (2015.04)

(58) Field of Classification Search

CPC ..... D06F 39/083

See application file for complete search history.

(56) References Cited

U.S. PATENT DOCUMENTS

2004/0103697 A1 6/2004 Kim et al.

FOREIGN PATENT DOCUMENTS

| | | |
|---|---|---|
| JP | 2000-237497 | 9/2000 |
| KR | 2000-0032394 | 6/2000 |
| KR | 10-2007-0082378 | 8/2007 |
| KR | 10-2008-0064763 | 7/2008 |

OTHER PUBLICATIONS

PCT International Search Report mailed Nov. 20, 2014 in corresponding International Patent Application No. PCT/KR2014/007332.

*Primary Examiner* — Jason Ko

(74) *Attorney, Agent, or Firm* — Staas & Halsey LLP

(57) ABSTRACT

A washing machine includes a cabinet; a tub which is disposed in the cabinet and in which washing water is stored; a drain hose that guides the washing water in the tub toward an outer side of the cabinet; and a siphonage prevention unit disposed on the drain hose, wherein the siphonage prevention unit includes: a connection pipe having a connection flow path that communicates with the drain hose; an air pipe having an air flow path that communicates with the connection flow path; and a protrusion that is disposed adjacent to a communication portion in which the connection flow path and the air flow path communicate with each other and that protrudes from an inner side surface of the connection pipe. Through this configuration, a siphonage phenomenon in the drain hose can be prevented.

24 Claims, 12 Drawing Sheets

WASHING MACHINE

CROSS-REFERENCE TO RELATED APPLICATIONS

This application claims the benefit of U.S. Pat. application No. 61/863,085, filed on Aug. 7, 2013 in USPTO and Korean Patent Application No. 10-2013-0093674, filed on Aug. 7, 2013 in the Korean Intellectual Property Office, the disclosures of which are incorporated herein by reference.

BACKGROUND

1. Field

Embodiments of the present disclosure relate to a washing machine, and more particularly, to a washing machine having an improved drainage structure.

2. Description of the Related Art

A washing machine as a machine that washes clothes using power, generally includes a tub in which washing water is stored, a rotating tub that is rotatably installed in the tub, a driving unit for driving the rotating tub by rotation, a water supply unit for supplying washing water to the tub, and a drain pump for forcibly discharging washing water in the tub.

Washing water pumped by the drain pump is discharged to an outer side of the washing machine via a connection pipe. In this procedure, washing water is fully filled in an inner side of the connection pipe such that a siphonage phenomenon occurs due to a difference in heights of the tub and the outer side of the washing machine. Due to the siphonage phenomenon, the amount of washing water discharged cannot be adjusted.

SUMMARY

Therefore, it is an aspect of the present disclosure to provide a washing machine having an improved drainage structure in which a siphonage phenomenon can be prevented.

It is another aspect of the present disclosure to provide a washing machine that prevents accumulation of lint within a connection pipe.

Additional aspects of the disclosure will be set forth in part in the description which follows and, in part, will be apparent from the description, or may be learned by practice of the disclosure.

In accordance with one aspect of the present disclosure, there is provided a washing machine including: a cabinet; a tub which is disposed in the cabinet and in which washing water is stored; a drain hose that guides the washing water in the tub toward an outer side of the cabinet; and a siphonage prevention unit disposed on the drain hose, wherein the siphonage prevention unit may include: a connection pipe having a connection flow path that communicates with the drain hose; an air pipe having an air flow path that communicates with the connection flow path; and a protrusion that is disposed adjacent to a communication portion in which the connection flow path and the air flow path communicate with each other and that protrudes from an inner side surface of the connection pipe.

The protrusion may be disposed at a lower side than the communication portion.

The protrusion may include a flow path inclination surface that protrudes to be inclined from the inner side surface of the connection pipe as the protrusion gets closer to a downstream part from an upstream part of the connection flow path.

The flow path inclination surface and the communication portion may be disposed in the same line with respect to a lengthwise direction of the connection pipe.

The protrusion may further include an auxiliary inclination surface that is disposed more downstream than the flow path inclination surface and that is inclined toward the inner side surface of the connection pipe as the auxiliary inclination surface gets closer to the downstream part from the upstream part of the connection flow path.

An angle formed between the auxiliary inclination surface and the inner side surface of the connection pipe may be larger than an angle formed between the flow path inclination surface and the inner side surface of the connection pipe.

The flow path inclination surface may include a first width that is perpendicular to a washing water progression direction and a second width that is parallel to the first width and is disposed at a more downstream part of the connection flow path than the first width, and the second width may be larger than the first width.

A width of at least a portion of the flow path inclination surface with respect to a lengthwise direction that is the washing water progression direction may be formed larger than a diameter of the air flow path.

The washing water discharged through the connection flow path may avoid the communication portion and flow due to the protrusion.

The washing machine may further include: a drain pump that pumps the washing water stored in the tub; a drain pipe that connects the tub and the drain pump; and a drain hose that connects the drain pump and the outer side of the cabinet, wherein the siphonage prevention unit may be disposed on the drain hose.

The drain hose may include a first drain hose disposed in a vertical direction, and the siphonage prevention unit may be disposed on the first drain hose.

The washing machine may further include a detergent supply unit that supplies detergent and the washing water into the tub, wherein the air pipe may communicate with a top end of the tub or the detergent supply unit.

The protrusion may include a flow path inclination rib that extends from an upstream part of the communication portion and is spaced apart from the inner side surface of the connection pipe as the protrusion gets closer to the downstream part from the upstream part of the communication portion.

The flow path inclination rib may include: a first rib inclination surface that is inclined to be spaced apart from the inner side surface of the connection pipe as the first rib inclination surface gets closer to the downstream part from the upstream part of the connection flow path; and a second rib inclination surface provided to face the communication portion at an opposite side of the first rib inclination surface.

The flow path inclination rib may control a flow of the washing water through the connection flow path via the first rib inclination surface and may control a flow of air introduced into the connection flow path through the air flow path via the second rib inclination surface.

The protrusion may include a flow path switching surface that protrudes toward a center of the connection flow path from the inner side surface of the connection pipe.

At least a portion of the flow path switching surface may be formed as a curved surface.

In accordance with another aspect of the present disclosure, there is provided a washing machine including: a cabinet; a tub which is disposed in the cabinet and in which washing water is stored; a drain pump that pumps the washing water stored in the tub; a drain hose that guides the washing water in the tub toward an outer side of the cabinet; and a siphonage prevention unit disposed on the drain hose, wherein the siphonage prevention unit may include: a connection pipe having a connection flow path that communicates with the drain hose; an air pipe having an air flow path that communicates with the connection flow path so that air is capable of being introduced into the connection flow path; and a protrusion that is disposed within the connection pipe, at a more upstream part of the connection flow path than a communication portion in which the connection flow path and the air flow path are connected to each other, such that the washing water that passes through the connection flow path detours to the communication portion.

The protrusion may include a flow path inclination surface that is inclined toward a center of the connection flow path so that, when the drain pump operates, the washing water discharged from the tub is discharged by detouring to the communication portion.

The washing machine may further include a detergent supply unit that injects detergent or the washing water into the tub, wherein one end of the air flow path may communicate with a top end of the tub or the detergent supply unit so that, when an operation of the drain pump stops, air is absorbed from the tub or the detergent supply unit and is transferred to the connection flow path via the air flow path.

In accordance with still another aspect of the present disclosure, there is provided a washing machine including: a cabinet; a tub which is disposed in the cabinet and in which washing water is stored; a drain pump that pumps the washing water stored in the tub; a drain pipe that communicates the tub with the drain pump; a drain hose including a first drain hose disposed in a vertical direction and a second drain hose that connects the drain pump and the first drain hose, the drain hose communicating the drain pump with an outer side of the cabinet; and a siphonage prevention unit including a connection pipe having a connection flow path through which washing water is discharged into the connection pipe and an air pipe through which air is capable of being introduced into the connection pipe, the siphonage prevention unit being disposed on the first drain hose.

The siphonage prevention unit may further include a protrusion that is disposed at an upstream part of a communication portion in which the connection flow path and the air flow path communicate with each other and that protrudes toward the connection flow path rather than an adjacent inner side surface of the connection pipe.

The siphonage prevention unit may further include a fixing flange provided at the air pipe in a form of a flange so that the fixing flange is capable of being fixed to the cabinet.

The cabinet may include: a front frame that constitutes a front side of the cabinet; side frames that constitute sides and a rear side of the cabinet; and a bottom frame that constitutes a bottom side of the cabinet, and the fixing flange may be fixed to the side frames.

The tub may include: a water storage portion in which the washing water is stored when washing is performed; and an air portion in which air is contained from an upper part of the water storage portion, and an end of the air pipe may communicate with the air portion.

The washing machine may further include a detergent supply unit that supplies detergent and the washing water into the tub, wherein an end of the air pipe may communicate with the detergent supply unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
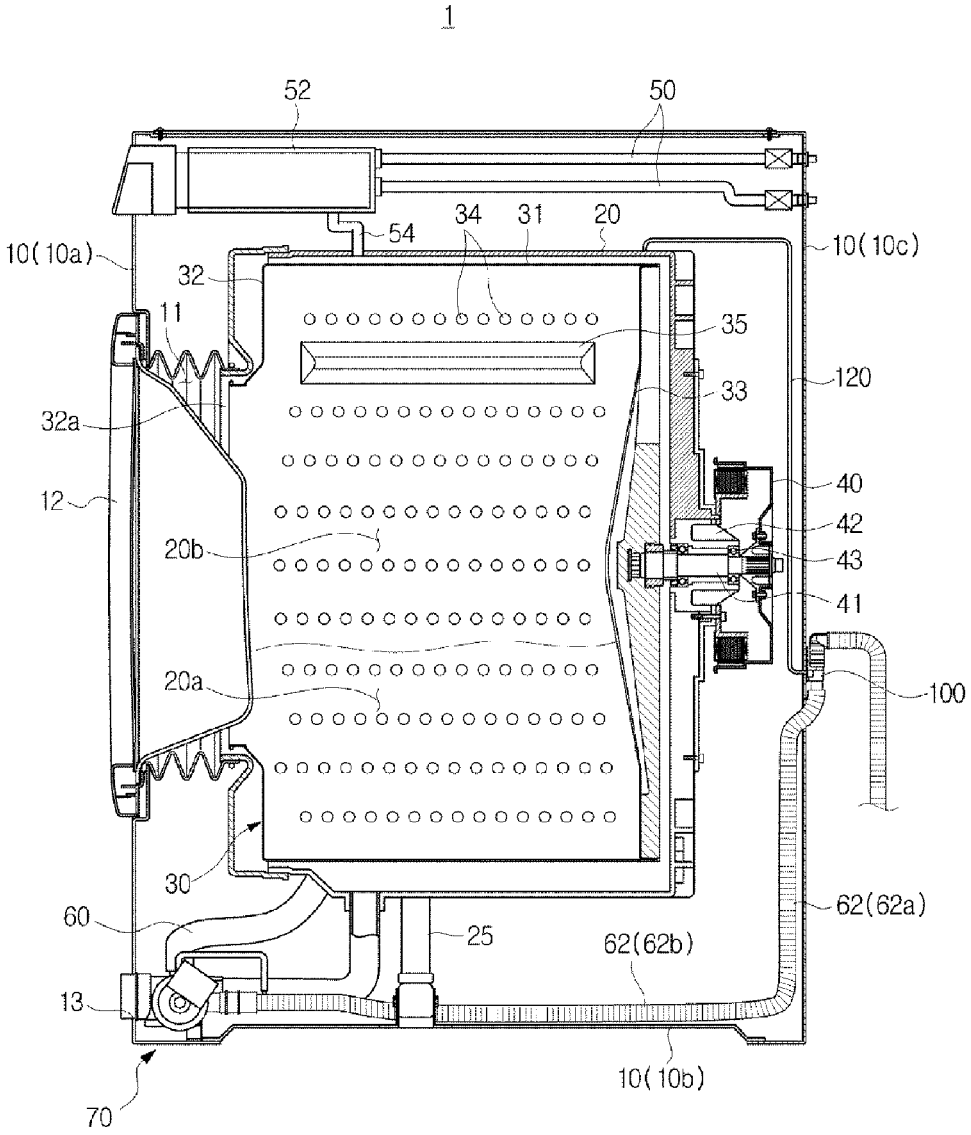
FIG. 1 is a cross-sectional view of a washing machine according to a first embodiment of the present disclosure.

Reference will now be made in detail to the embodiments of the present disclosure, examples of which are illustrated in the accompanying drawings, wherein like reference numerals refer to like elements throughout.

Figure 2:
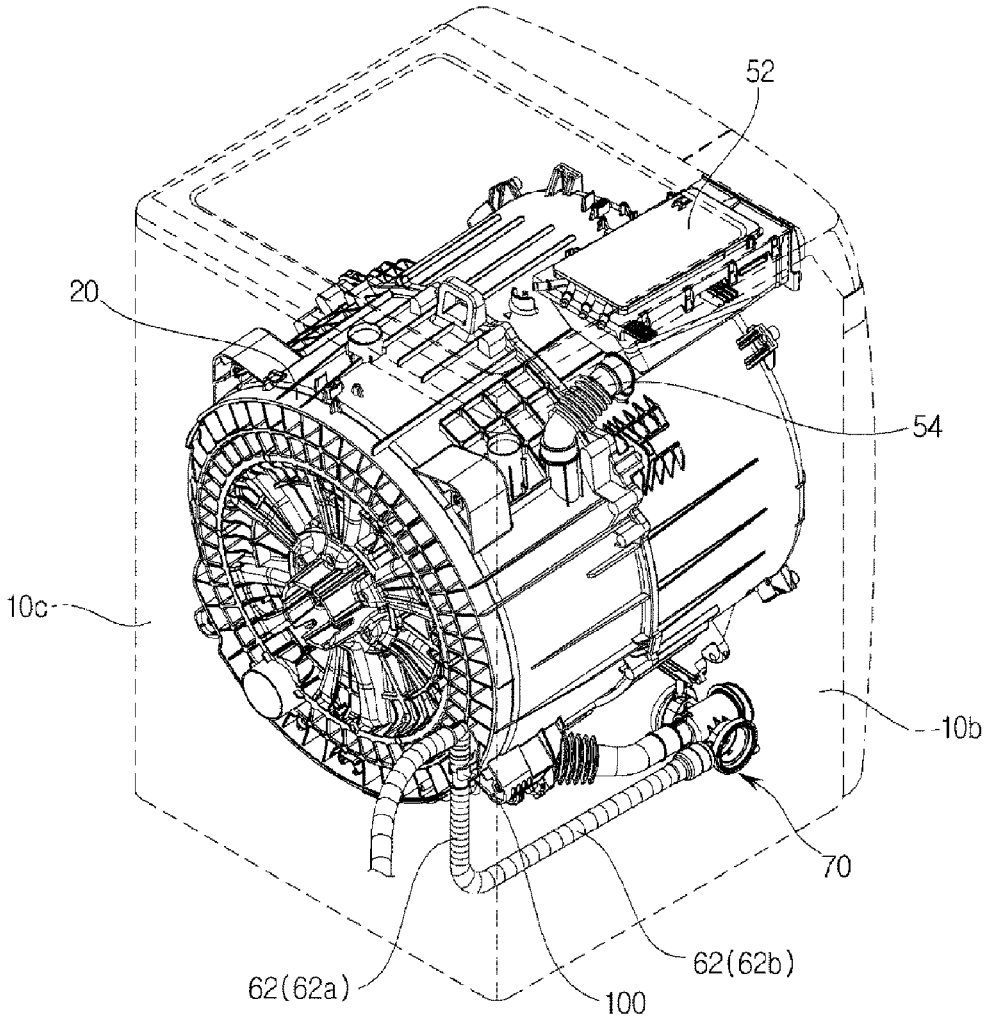
FIG. 2 illustrates a partial configuration of the washing machine illustrated in FIG. 1.

FIG. 1 is a cross-sectional view of a washing machine according to a first embodiment of the present disclosure, and FIG. 2 illustrates a partial configuration of the washing machine illustrated in FIG. 1.

Referring to FIG. 1, a washing machine 1 includes a cabinet 10 that constitutes an exterior, a tub 20 that is disposed in the cabinet 10, a rotating tub 30 that is rotatably disposed in the tub 20, and a motor 40 that drives the rotating tub 30.

The cabinet 10 includes a plurality of frames 10*a*, 10*b*, and 10*c*. The plurality of frames 10*a*, 10*b*, and 10*c* include a front frame 10*a* that constitutes a front side of the cabinet 10, side frames 10*c* that constitute sides and a rear side of the cabinet 10, and a bottom frame 10*b* that constitutes a bottom side of the cabinet 10.

A portion that is upwardly bent and is combined with the front frame 10*a* may be formed at a front side of the bottom frame 10*b*.

A laundry port 11 through which laundry may be put into the rotating tub 30, is formed at the front side of the cabinet 10. The laundry port 11 is opened and closed by a door 12 installed at the front side of the cabinet 10.

The tub 20 is supported by a damper 25. The damper 25 connects an inner bottom side of the cabinet 10 and an outer side of the tub 20.

A water supply pipe 50 is installed at an upper portion of the tub 20 so as to supply washing water to the tub 20. One side of the water supply pipe 50 is connected to an external water supply source (not shown), and the other side of the water supply pipe 50 is connected to a detergent supply unit 52.

The detergent supply unit 52 is connected to the tub 20 via a connection pipe 54. Water supplied via the water supply pipe 50 is supplied into the tub 20 together with detergent via the detergent supply unit 52.

The rotating tub 30 includes a cylindrical part 31, a front panel 32 disposed on the front of the cylindrical part 31, and a rear panel 33 disposed on the rear of the cylindrical part 31. An opening 32*a* through which laundry is put into the rotating tub 30, is formed in the front panel 32, and a driving shaft 41 is connected to the rear panel 33 so as to transfer power of the motor 40.

A plurality of through holes 34 through which washing water flows in or out, are formed in a circumference of the rotating tub 30 such that an internal space of the rotating tub 30 and an internal space of the tub 20 communicate with each other.

A plurality of lifters 35 are installed at an inner circumferential surface of the rotating tub 30 so that laundry can ascend or descend when the rotating tub 30 rotates.

The driving shaft 41 is disposed between the rotating tub 30 and the motor 40. One end of the driving shaft 41 is connected to the rear panel 33 of the rotating tub 30, and the other end of the driving shaft 41 extends to an outer side of a rear wall of the tub 20. When the motor 40 drives the driving shaft 41, the rotating tub 30 connected to the driving shaft 41 rotates around the driving shaft 41.

A bearing housing 42 is installed at the rear wall of the tub 20 so as to rotatably support the driving shaft 41. The bearing housing 42 may be formed of an aluminum alloy and may be inserted into the rear wall of the tub 20 when the tub 20 is injection molded. A plurality of bearings 43 are installed between the bearing housing 42 and the driving shaft 41 so that the driving shaft 41 can be smoothly rotated.

When a washing operation is performed, the motor 40 causes the rotating tub 30 to rotate in a forward/reverse direction at a low speed. Thus, contaminant is removed from laundry while laundry inside the rotating tub 30 ascends or descends repeatedly.

When a dehydration operation is performed, if the motor 40 causes the rotating tub 30 to rotate in one direction at a high speed, water is separated from laundry due to a centrifugal force exerted on laundry.

A drain pump 70 is installed at an inner lower portion of the cabinet 10 so as to pump washing water stored in the tub 20. Washing water is pumped by the drain pump 70, is guided by a drain pipe 60 and a drain hose 62 and thus is discharged to an outer side of the washing machine 1.

The drain pump 70 is exposed to the front side of the cabinet 10 via through holes 13 formed in a portion where a protrusion part of the bottom frame 10*b* and a bottom end of the front frame 10*a* overlap each other.

As illustrated in FIG. 2, a siphonage prevention unit 100 may be disposed on the drain hose 62 so as to prevent a siphonage phenomenon in the drain hose 62.

The drain pipe 60 is a section in which the tub 20 and the drain pump 70 communicate with each other, and the drain hose 62 is a section in which the drain pump 70 and an outer side of the cabinet 10 communicate with each other.

The drain hose 62 is configured to guide washing water pumped by the drain pump 70 toward the outer side of the cabinet 10, and at least a portion of a section of the drain hose 62 is formed higher than a water level of the tub 20 so as to prevent natural drainage.

To this end, the drain hose 62 may include a first drain hose 62*a* disposed in a vertical direction, and a second drain hose 62*b* that connects the drain pump 70 and the first drain hose 62*a*. The siphonage prevention unit 100 may be disposed on the first drain hose 62*a*. An arrangement state of the siphonage prevention unit 100 is not limited thereto, and the siphonage prevention unit 100 may also be disposed in any portion of a section of the first drain hose 62*a* in which the siphonage phenomenon occurs.

Washing water is fully filled in the drain pipe 60 and the drain hose 62 such that drainage is continuously performed due to a pressure difference between both ends of the drain pipe 60 and the drain hose 62 and adjustment of drainage becomes difficult. As the siphonage prevention unit 100 is disposed on the drain hose 62, the siphonage phenomenon can be prevented.

Figure 3:
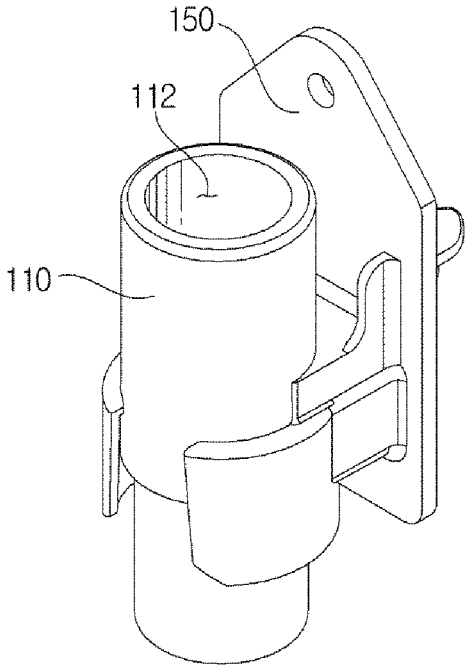
FIG. 3 illustrates a siphonage prevention unit of the washing machine of FIG. 1.
Figure 4:
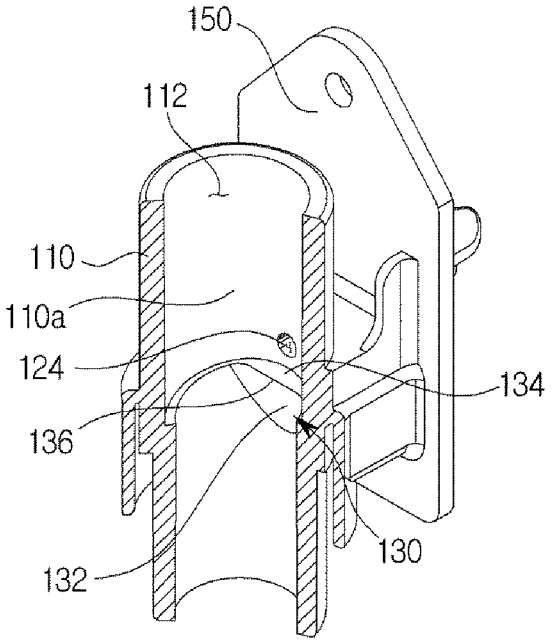
FIG. 4 is a cross-sectional perspective view of the siphonage prevention unit of the washing machine of FIG. 1.
Figure 5:
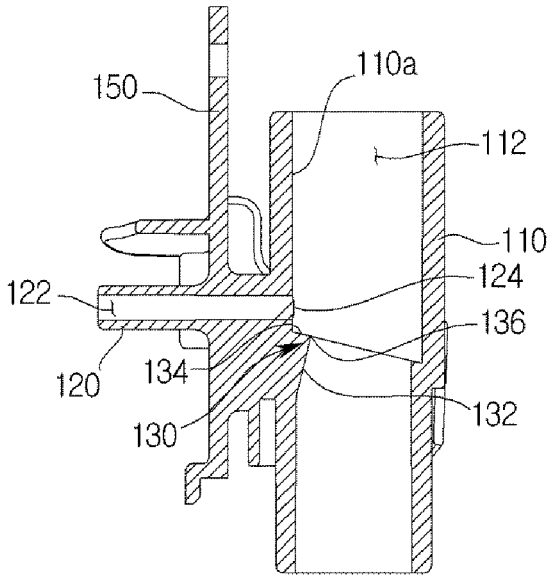
FIG. 5 is a cross-sectional view of the siphonage prevention unit of the washing machine of FIG. 1.
Figure 6:
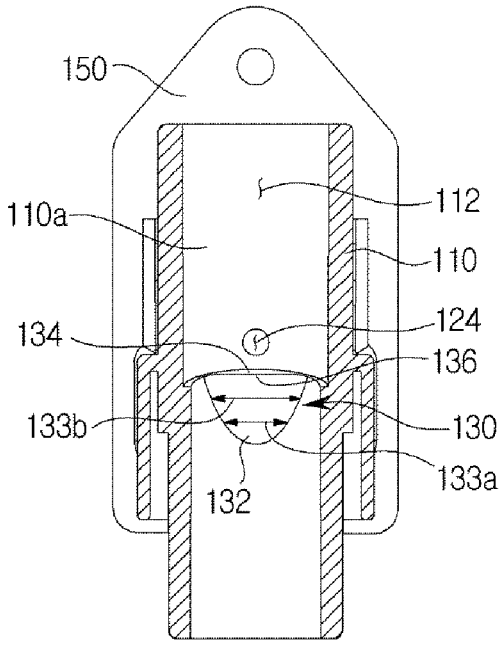
FIG. 6 is another cross-sectional view of the siphonage prevention unit of the washing machine of FIG. 1

FIG. 3 illustrates a siphonage prevention unit of the washing machine of FIG. 1, FIG. 4 is a cross-sectional perspective view of the siphonage prevention unit of the washing machine of FIG. 1, FIG. 5 is a cross-sectional view of the siphonage prevention unit of the washing machine of FIG. 1, and FIG. 6 is another cross-sectional view of the siphonage prevention unit of the washing machine of FIG. 1.

The siphonage prevention unit 100 may include a connection pipe 110, an air pipe 120, and a protrusion 130.

The connection pipe 110 is configured to be connected to the drain hose 62, and a connection flow path 112 that communicates with a drain flow path inside the drain hose 62 may be formed in the connection pipe 110.

The air pipe 120 is configured to be combined with the connection pipe 110 and to have an air flow path 122 that communicates with the connection flow path 112. When the drain pump 70 operates, washing water flows on the connection flow path 112, and when an operation of the drain pump 70 stops, a pulling pressure is applied to an end that is opposite to the drain hose 62, air flows into the air pipe 120 via the air flow path 122, and air is introduced into the connection flow path 112 so that the siphonage phenomenon can be prevented.

One end of the air pipe 120 is disposed to be combined with the connection pipe 110, and the other end of the air pipe 120 is disposed to be opened in the air. That is, air is supplied from the other end of the air pipe 120 to the connection flow path 112.

In detail, the tub 20 includes a water storage portion 20*a* in which washing water is stored, and an air portion 20*b* in which air is contained from an upper part of the water storage portion 20*a*, and the other end of the air pipe 120 may communicate with the air portion 20*b*. The other end of the air pipe 120 may be connected to the air portion 20*b* of the tub 20 or the upper part of the tub 20 in this way or may be connected to the detergent supply unit 52. Arrangement of the air pipe 120 is not limited thereto, and the air pipe 120 may be disposed in such a way that air introduced from the other end of the air pipe 120 can be discharged to one end of the air pipe 120.

Air may be supplied via the air pipe 120 when an operation of the drain pump 70 stops, so as to prevent the siphonage phenomenon. However, the air flow path 122 communicates with the connection flow path 112 so that a predetermined amount of washing water that flows through the connection flow path 112 may also flow through the air flow path 122 when drainage of the washing machine 1 is performed. In detail, in terms of the operation of the drain pump 70, when drainage is performed due to the operation of the drain pump 70, pressure is applied to the drain pump 70 so as to push washing water from the tub 20 toward the outer side of the washing machine 1 such that a predetermined amount of washing water that passes through the connection flow path 112 may also flow into the air flow path 122.

In this case, pressure in a communication portion 124 in which the connection flow path 112 and the air flow path 122 cross each other, increases, and a flow velocity of the connection flow path 112 is reduced. Also, when, in this procedure, lint and foreign substances included in washing water are accumulated on the communication portion 124 and the air flow path 122 is blocked, introduction of air through the air flow path 122 is not smoothly performed, and the siphonage prevention unit 100 cannot perform its function.

The siphonage prevention unit 100 may include the protrusion 130.

The protrusion 130 is configured to prevent an increase in pressure and a reduction in a flow velocity of the connection flow path 112 at the communication portion 124 when washing water avoids the air flow path 122 and flows through the connection flow path 112, as described above.

The protrusion 130 may be disposed adjacent to the communication portion 124. In detail, the protrusion 130 may be disposed at an upstream part of the communication portion 124 in which the connection flow path 112 and the air flow path 122 communicate with each other, such that washing water can be discharged by detouring to the communication portion 124 in a drainage procedure. Since, in the current embodiment of the present disclosure, washing water that passes through the connection flow path 112 flows from a lower part to an upper part of the connection flow path 112, the upstream part of the communication portion 124 is a lower side of the communication portion 124. Thus, as illustrated in FIGS. 4 through 8, the protrusion 130 is disposed at the lower side of the communication portion 124.

The protrusion 130 may be provided to protrude from an inner side surface 110*a* of the connection pipe 110. In detail, the protrusion 130 may be provided to protrude toward the connection flow path 112 rather than the adjacent inner side surface 110*a* of the connection pipe 110.

The protrusion 130 may include a flow path inclination surface 132 that is inclined to be spaced from the inner side surface 110*a* of the connection pipe 110 as the protrusion 130 gets closer to a downstream part from an upstream part of the connection flow path 112. In other words, the flow path inclination surface 132 may be provided to be inclined toward a center of the connection flow path 112 so that washing water may avoid the communication portion 124 and may be discharged. The flow path inclination surface 132 may be provided so that washing water discharged toward the communication portion 124 may not flow in as the washing water is guided from the upstream part of the communication portion 124 toward the center of the connection flow path 112.

Thus, the flow path inclination surface 132 and the communication portion 124 may be disposed in the same line with respect to a lengthwise direction of the connection pipe 110 that passes through the connection flow path 112.

The flow path inclination surface 132 is provided so that washing water on the connection flow path 112 may flow from a downstream end of the flow path inclination surface 132 in a state in which the flow path inclination surface 132 is spaced apart from the communication portion 124. That is, a streamline s1 that passes through the flow path inclination surface 132 may avoid the communication portion 124, may pass through the communication portion 124, and then may be formed along the inner side surface 110*a* of the connection pipe 110.

A first width 133*a* of at least a portion of the flow path inclination surface 132 measured perpendicular to a washing water progression direction may be formed larger than a diameter of the air flow path 122. As the first width 133*a* of at least a portion of the flow path inclination surface 132 is formed larger than the diameter of the air flow path 122, washing water that passes through the flow path inclination surface 132 may be sufficiently guided so that introduction of washing water into the air flow path 122 can be prevented. With respect to the first width 133*a* of at least a portion of the flow path inclination surface 132 perpendicular to the washing water progression direction, a second width 133*b* disposed more downstream than the first width 133*a* may be larger than the first width 133*a*. That is, since the flow path inclination surface 132 is inclined toward the center of the connection flow path 112 from the upstream part to the downstream part of the connection flow path 112, the width of the flow path inclination surface 132 may be increased.

An angle formed between the flow path inclination surface 132 and the inner side surface 110*a* of the connection pipe 110 is not limited and may be used in consideration of an inner diameter of the connection pipe 110, an inner diameter of the air pipe 120, and water pressure of washing water. The flow path inclination surface 132 may be formed as a planar surface or a curved surface. In the current embodiment of the present disclosure, the flow path inclination surface 132 is formed as a planar surface. However, embodiments of the present disclosure are not limited thereto, and the flow path inclination surface 132 may be configured to be inclined so as to prevent introduction of washing water into the air flow path 122 by converting a flow of washing water.

The protrusion 130 may further include an auxiliary inclination surface 134 that is disposed more downstream than the flow path inclination surface 132 and is inclined toward the inner side surface 110*a* of the connection pipe 110 from the upstream part to the downstream part of the connection flow path 112. In other words, the auxiliary inclination surface 134 may be provided to be spaced apart from the inner side surface 110*a* of the connection pipe 110 as the protrusion 130 gets closer to the upstream part from the downstream part of the connection flow path 112. That is, an inclination direction of the auxiliary inclination surface 134 may be opposite to that of the flow path inclination surface 132.

An angle formed between the auxiliary inclination surface 134 and the inner side surface 110*a* of the connection pipe 110 may be larger than the angle formed between the flow path inclination surface 132 and the inner side surface 110*a* of the connection pipe 110. Through this configuration, the streamline s1 that flows along the flow path inclination surface 132 may not flow along the auxiliary inclination surface 134 but may flow in a state in which the streamline s1 is spaced apart from the communication portion 124.

The flow path inclination surface 132 and the auxiliary inclination surface 134 may be respectively formed at the upstream part and the downstream part of the connection flow path 112 in a state in which a mountain part 136 is a border between the flow path inclination surface 132 and the auxiliary inclination surface 134. A center of the mountain part 136 is most spaced from the inner side surface 110*a* of the connection pipe 110, and a width of the mountain part 136 may be the same as a maximum width of the flow path inclination surface 132. The width of the mountain part 136 may be larger than the diameter of the air flow path 122.

The siphonage prevention unit 100 may further include a fixing flange 150.

The fixing flange 150 is configured so that the siphonage prevention unit 100 can be fixed to the cabinet 10 and may be provided in the form of a flange on an outer circumferential part of the air pipe 120. The siphonage prevention unit 100 is provided to be fixed to the side frames 10*c* of the cabinet 10, to fix the drain hose 62, and to prevent the siphonage phenomenon with respect to the drain hose 62.

Figure 7:
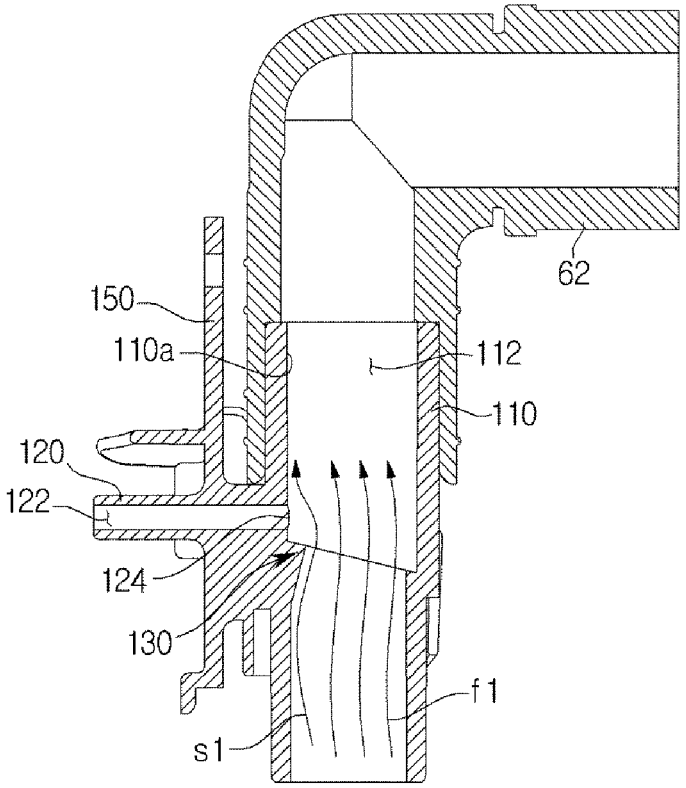
FIGS. 7 and 8 illustrate a flow of washing water in the washing machine of FIG. 1.
Figure 8:
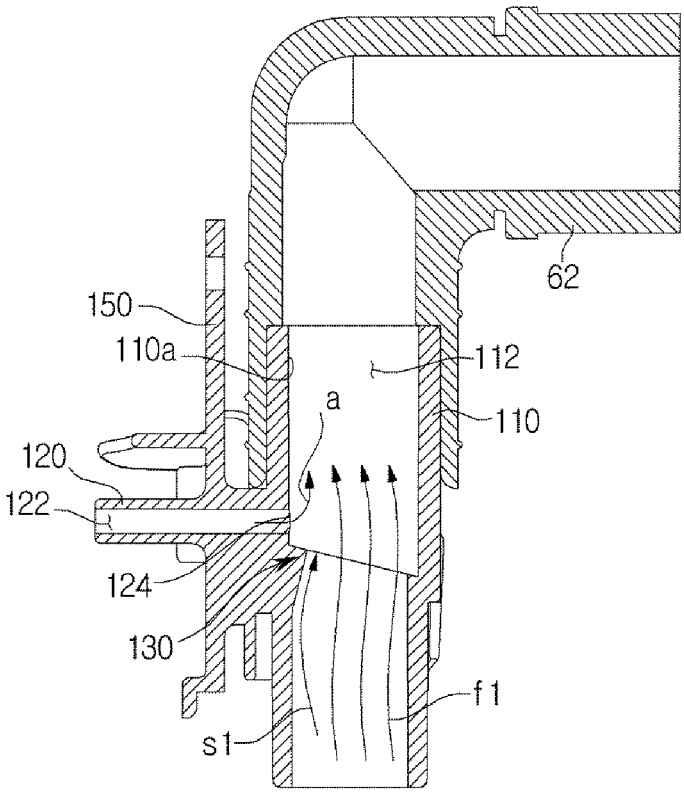

FIGS. 7 and 8 illustrate a flow of washing water in the washing machine 1 illustrated in FIG. 1

Based on the drain hose 62, pressure from the drain pump 70 that pumps washing water and discharges washing water to the outer side of the washing machine 1, and an external pressure that is generated at an end of the drain hose 62 and is associated with an atmospheric pressure of the outer side of the washing machine 1 are applied onto the drain hose 62.

When the drain pump 70 operates, a larger pressure from the drain pump 70 is applied onto the drain hose 62, and washing water is pumped and is discharged from the tub 20 toward the outer side of the cabinet 10. Washing water flows (f1) through the siphonage prevention unit 100 disposed on the drain hose 62, as illustrated in FIG. 7.

In this procedure, the streamline s1 that passes through the flow path inclination surface 132 of the protrusion 130 detours to the communication portion 124, and introduction of washing water into the air flow path 122 can be prevented or reduced.

When the operation of the drain pump 70 stops, a larger external pressure is applied onto the drain hose 62, and thus, force that pulls washing water toward the end of the drain hose 62 is generated. Thus, a flow f2 of washing water and a flow a of air occur, as illustrated in FIG. 7.

In this procedure, since air is introduced into the connection flow path 112 via the air flow path 122, the siphonage phenomenon in which washing water is continuously discharged, can be prevented.

In another aspect, the protrusion 130 prevents introduction of washing water into one end of the air flow path 122 and guides air from the other end to the one end of the air flow path 122, and thus serves as a check valve of the air flow path 122. That is, a configuration of the protrusion 130 is improved without adding a separate valve so that the protrusion 130 may perform the same function as that of the check valve.

Hereinafter, a washing machine according to a second embodiment of the present disclosure will be described.

Description of a redundant configuration of the second embodiment compared to the first embodiment will be omitted.

Figure 9:
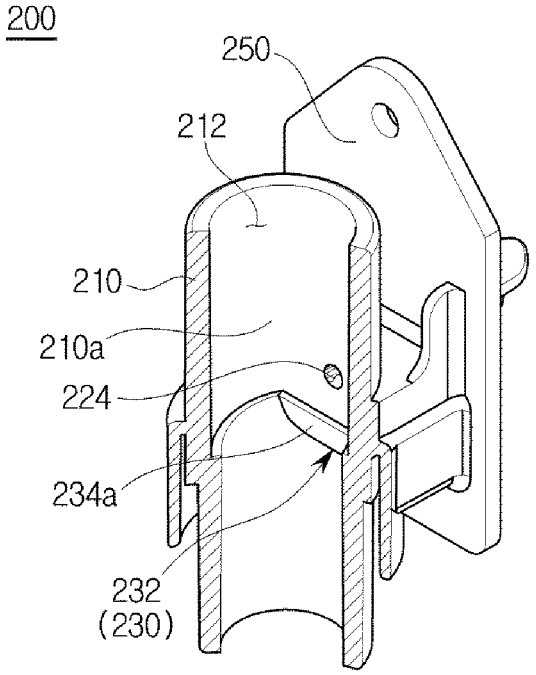
FIG. 9 is a cross-sectional perspective view of a washing machine according to a second embodiment of the present disclosure.
Figure 10:
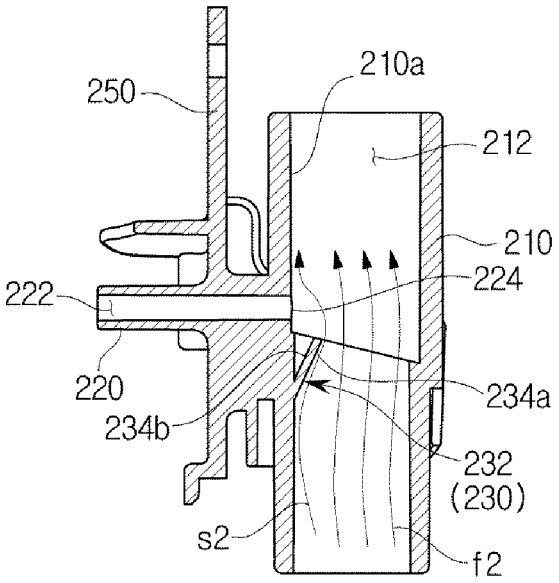
FIG. 10 is a cross-sectional view of the washing machine illustrated in FIG. 9.

FIG. 9 is a cross-sectional perspective view of a washing machine according to a second embodiment of the present disclosure, and FIG. 10 is a cross-sectional view of the washing machine illustrated in FIG. 9.

A siphonage prevention unit 200 includes a connection pipe 210, an air pipe 220, and a protrusion 230.

The connection pipe 210 is configured to communicate with a drain hose 62 and to have a connection flow path 212. The air pipe 220 is configured to have an air flow path 222 that meets with the connection flow path 212 and to be connected to the connection pipe 210. The protrusion 230 is configured to be disposed at an upstream part of a communication portion 224 in which the connection flow path 212 and the air flow path 222 communicate with each other. The protrusion 230 protrudes toward the connection flow path 212 rather than an adjacent inner side surface 210*a* of the connection pipe 210.

The protrusion 230 may include a flow path inclination rib 232

The flow path inclination rib 232 may be disposed at the upstream part of the communication portion 224 and may be inclined toward a center of the connection flow path 212 as the flow path inclination rib 232 gets closer to a downstream part from the upstream part of the communication portion 224.

The flow path inclination rib 232 may include a first rib inclination surface 234*a* and a second rib inclination surface 234*b*.

The first rib inclination surface 234*a* may be inclined to be spaced apart from the inner side surface 210*a* of the connection pipe 210 as the first rib inclination surface 234*a* gets closer to the downstream part from the upstream part of the connection flow path 212. In other words, the first rib inclination surface 234*a* may be inclined toward the center of the connection flow path 212.

The second rib inclination surface 234*b* may be provided to face the communication portion 224 at an opposite side of the first rib inclination surface 234*a*.

The first rib inclination surface 234*a* controls a flow of washing water discharged through the connection flow path 212, and the second rib inclination surface 234*b* controls a flow of air introduced into the connection flow path 212 through the air flow path 222.

That is, the first rib inclination surface 234*a* and the second rib inclination surface 234*b* guide introduction of discharged washing water and air, thereby preventing discharged washing water from being introduced into the air flow path 222. Through this configuration, in the flow f2 of washing water, a streamline s2 that flows along the first rib inclination surface 234*a* may flow in a state in which the streamline s2 is spaced apart from the communication portion 224.

Reference numeral 250 is a fixing flange and has the same configuration as that of the first embodiment.

Hereinafter, a washing machine according to a third embodiment of the present disclosure will be described.

Description of a redundant configuration of the third embodiment compared to the first and second embodiments will be omitted.

Figure 11:
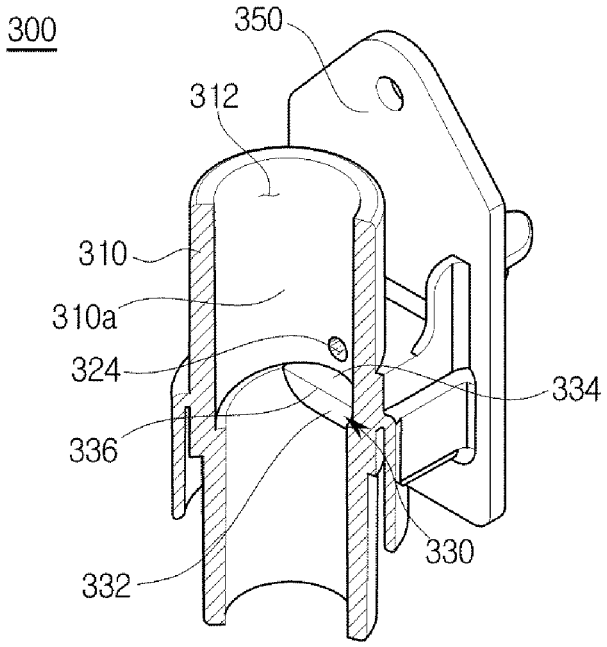
FIG. 11 is a cross-sectional perspective view of a washing machine according to a third embodiment of the present disclosure.
Figure 12:
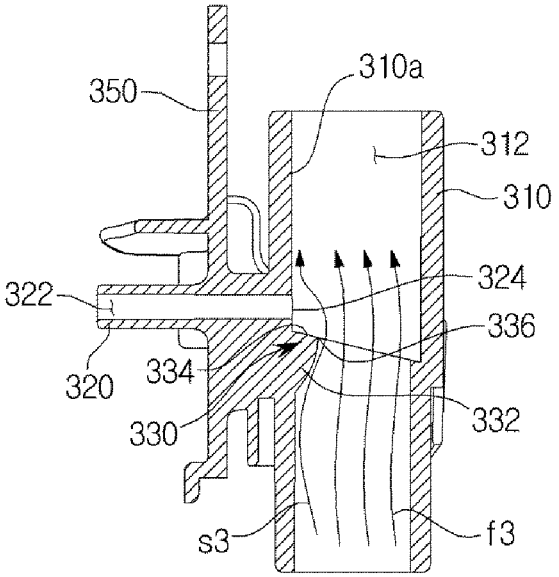
FIG. 12 is a cross-sectional view of the washing machine illustrated in FIG. 11.

FIG. 11 is a cross-sectional perspective view of a washing machine according to a third embodiment of the present disclosure, and FIG. 12 is a cross-sectional view of the washing machine illustrated in FIG. 11.

A siphonage prevention unit 300 includes a connection pipe 310, an air pipe 320, and a protrusion 330.

The connection pipe 310 is configured to communicate with a drain hose and to have a connection flow path 312, and the air pipe 320 is configured to have an air flow path 322 that meets with the connection flow path 312 and to be connected to the connection pipe 310. The protrusion 330 is configured to be disposed at an upstream part of a communication portion 324 in which the connection flow path 312 and the air flow path 322 communicate with each other. The protrusion 330 protrudes toward the connection flow path 312 rather than an adjacent inner side surface 310*a* of the connection pipe 310.

The protrusion 330 may include a flow path switching surface 332.

The flow path switching surface 332 is configured to protrude toward a center of the connection flow path 312 from the inner side surface 310*a* of the connection pipe 310.

The flow path switching surface 332 may be provided to be convex toward the center of the connection flow path 312 rather than the adjacent inner side surface 310*a* of the connection pipe 310.

The flow path switching surface 332 may be provided in a shape in which at least a portion of the flow path switching surface 332 has a curved surface, and a streamline s3 may be formed in such a way that washing water that passes through the flow path switching surface 332 formed as a curved surface may pass through the communication portion 324 and may flow along the inner side surface 310*a* of the connection pipe 310.

The protrusion 330 may further include an auxiliary inclination surface 334 that is disposed more downstream than the flow path switching surface 332 and is inclined toward the inner side surface 310*a* of the connection pipe 310 as the protrusion 330 gets closer to the downstream part from the upstream part of the connection flow path 312. In other words, the auxiliary inclination surface 334 may be provided to be spaced apart from the inner side surface 310*a* of the connection pipe 310 as the auxiliary inclination surface 334 gets closer to the upstream part from the downstream part of the connection flow path 312. That is, an inclination direction of the auxiliary inclination surface 334 may be opposite to that of the flow path switching surface 332.

An angle formed between the auxiliary inclination surface 334 and the inner side surface 310*a* of the connection pipe 310 may be larger than an angle formed between the flow path switching surface 332 and the inner side surface 310*a* of the connection pipe 310. Through this configuration, in a flow f3 of washing water, the streamline s3 that flows along the flow path switching surface 332 may not flow along the auxiliary inclination surface 334 but may flow in a state in which the streamline s3 is spaced apart from the communication portion 324.

The flow path switching surface 332 and the auxiliary inclination surface 334 may be respectively formed at the upstream part and the downstream part of the connection flow path 312 in a state in which a mountain part 336 is a border between the flow path switching surface 332 and the auxiliary inclination surface 334. A center of the mountain part 336 is most spaced from the inner side surface 310*a* of the connection pipe 310, and a width of the mountain part 336 may be the same as a maximum width of the flow path switching surface 332. The width of the mountain part 336 may be larger than a diameter of the air flow path 322.

Reference numeral 350 is a fixing flange and has the same configuration as that of the first embodiment.

As described above, in a washing machine according to the one or more embodiments of the present disclosure, a drainage structure is improved so that a siphonage phenomenon can be prevented and drainage efficiency can be improved. Also, accumulation of lint caused by a change in a flow velocity of an inner side of a connection pipe can be prevented.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a tub which is disposed in the cabinet and in which washing water is stored;

a drain hose that guides the washing water in the tub toward an outer side of the cabinet; and a siphonage prevention unit disposed on the drain hose, wherein the siphonage prevention unit comprises a connection pipe having a connection flow path that communicates with the drain hose;

an air pipe having an air flow path that communicates with the connection flow path; and a protrusion that is disposed adjacent to a communication portion in which the connection flow path and the air flow path communicate with each other and that protrudes from an inner side surface of the connection pipe, all of the protrusion being formed immediately upstream of the air pipe and configured to prevent an increase in pressure and a reduction in a flow velocity of the wash water in the connection flow path at the communication portion.

2. The washing machine of claim 1, wherein the protrusion comprises a flow path inclination surface that protrudes to be inclined from the inner side surface of the connection pipe as the protrusion gets closer to a downstream part from an upstream part of the connection flow path.

3. The washing machine of claim 2, wherein the flow path inclination surface and the communication portion are disposed in the same line with respect to a lengthwise direction of the connection pipe.

4. The washing machine of claim 2, wherein the protrusion further comprises an auxiliary inclination surface that is disposed more downstream than the flow path inclination surface and that is inclined toward the inner side surface of the connection pipe as the auxiliary inclination surface gets closer to the downstream part from the upstream part of the connection flow path.

5. The washing machine of claim 4, wherein an angle formed between the auxiliary inclination surface and the inner side surface of the connection pipe is larger than an angle formed between the flow path inclination surface and the inner side surface of the connection pipe.

6. The washing machine of claim 2, wherein the flow path inclination surface comprises a first width that is perpendicular to a washing water progression direction and a second width that is parallel to the first width and is disposed at a more downstream part of the connection flow path than the first width, and the second width is larger than the first width.

7. The washing machine of claim 2, wherein a width of at least a portion of the flow path inclination surface with respect to a lengthwise direction that is the washing water progression direction is formed larger than a diameter of the air flow path.

8. The washing machine of claim 1, wherein the washing water discharged through the connection flow path avoids the communication portion and flows due to the protrusion.

9. The washing machine of claim 1, further comprising:

a drain pump that pumps the washing water stored in the tub;

a drain pipe that connects the tub and the drain pump; and a drain hose that connects the drain pump and the outer side of the cabinet, wherein the siphonage prevention unit is disposed on the drain hose.

10. The washing machine of claim 9, wherein the drain hose comprises a first drain hose disposed in a vertical direction, and the siphonage prevention unit is disposed on the first drain hose.

11. The washing machine of claim 1, further comprising a detergent supply unit that supplies detergent and the washing water into the tub, wherein the air pipe communicates with a top end of the tub or the detergent supply unit.

12. The washing machine of claim 1, wherein the protrusion comprises a flow path inclination rib that extends from an upstream part of the communication portion and is spaced apart from the inner side surface of the connection pipe as the protrusion gets closer to the downstream part from the upstream part of the communication portion.

13. The washing machine of claim 12, wherein the flow path inclination rib comprises:

a first rib inclination surface that is inclined to be spaced apart from the inner side surface of the connection pipe as the first rib inclination surface gets closer to the downstream part from the upstream part of the connection flow path; and a second rib inclination surface provided to face the communication portion at an opposite side of the first rib inclination surface.

14. The washing machine of claim 13, wherein the flow path inclination rib controls a flow of the washing water through the connection flow path via the first rib inclination surface and controls a flow of air introduced into the connection flow path through the air flow path via the second rib inclination surface.

15. The washing machine of claim 1, wherein the protrusion comprises a flow path switching surface that protrudes toward a center of the connection flow path from the inner side surface of the connection pipe.

16. The washing machine of claim 15, wherein at least a portion of the flow path switching surface is formed as a curved surface.

17. A washing machine comprising:

a cabinet;

a tub which is disposed in the cabinet and in which washing water is stored;

a drain pump that pumps the washing water stored in the tub;

a drain hose that guides the washing water in the tub toward an outer side of the cabinet; and a siphonage prevention unit disposed on the drain hose, wherein the siphonage prevention unit comprises a connection pipe having a connection flow path that communicates with the drain hose;

an air pipe having an air flow path that communicates with the connection flow path so that air is capable of being introduced into the connection flow path; and a protrusion disposed within the connection pipe, all of the protrusion being formed immediately upstream of the air pipe and configured to prevent an increase in pressure and a reduction in a flow velocity of the wash water in the connection flow path at a communication portion, wherein the connection flow path and the air flow path are connected to each other at the communication portion, such that the washing water that passes through the connection flow path detours to the communication portion.

18. The washing machine of claim 17, wherein the protrusion comprises a flow path inclination surface that is inclined toward a center of the connection flow path so that, when the drain pump operates, the washing water discharged from the tub is discharged by detouring to the communication portion.

19. The washing machine of claim 17, further comprising a detergent supply unit that injects detergent or the washing water into the tub, wherein one end of the air flow path communicates with a top end of the tub or the detergent supply unit so that, when an operation of the drain pump stops, air is absorbed from the tub or the detergent supply unit and is transferred to the connection flow path via the air flow path.

20. A washing machine comprising:

a cabinet;

a tub which is disposed in the cabinet and in which washing water is stored;

a drain pump that pumps the washing water stored in the tub;

a drain pipe that communicates the tub with the drain pump;

a drain hose comprising a first drain hose disposed in a vertical direction and a second drain hose that connects the drain pump and the first drain hose, the drain hose communicating the drain pump with an outer side of the cabinet; and a siphonage prevention unit comprising a connection pipe having a connection flow path through which washing water is discharged into the connection pipe and an air pipe through which air is capable of being introduced into the connection pipe, the siphonage prevention unit being disposed on the first drain hose, and a protrusion disposed at an upstream part of a communication portion, all of the protrusion being formed immediately upstream of the air pipe and configured to prevent an increase in pressure and a reduction in a flow velocity of the wash water in the connection flow path at the communication portion, wherein the connection flow path and the air flow path communicate with each other at the communication portion, and the protrusion protrudes toward the connection flow path rather than an adjacent inner side surface of the connection pipe.

21. The washing machine of claim 20, wherein the siphonage prevention unit further comprises a fixing flange provided at the air pipe in a form of a flange so that the fixing flange is capable of being fixed to the cabinet.

22. The washing machine of claim 21, wherein the cabinet comprises:

a front frame that constitutes a front side of the cabinet;

side frames that constitute sides and a rear side of the cabinet; and a bottom frame that constitutes a bottom side of the cabinet, and the fixing flange is fixed to the side frames.

23. The washing machine of claim 20, wherein the tub comprises:

a water storage portion in which the washing water is stored when washing is performed; and an air portion in which air is contained from an upper part of the water storage portion, and an end of the air pipe communicates with the air portion.

24. The washing machine of claim 20, further comprising a detergent supply unit that supplies detergent and the washing water into the tub, wherein an end of the air pipe communicates with the detergent supply unit.

* * * * *